United States Patent [19]

Maggi

[11] Patent Number: 4,938,131

[45] Date of Patent: Jul. 3, 1990

[54] CLAMP DEVICE FOR THE CYLINDER WIPER BLADE IN A ROTOGRAVURE PRINTING MACHINE

[75] Inventor: Luigi Maggi, Piacenza, Italy

[73] Assignee: Schiavi Cesare Costruzioni Meccaniche S.p.A., Milano, Italy

[21] Appl. No.: 254,960

[22] Filed: Oct. 7, 1988

[30] Foreign Application Priority Data

May 15, 1987 [IT] Italy ..... 40054 A/87

[51] Int. Cl.[5] ..... B41F 9/10

[52] U.S. Cl. ..... 101/169; 15/256.51; 118/261

[58] Field of Search ..... 101/157, 169, 350, 363, 101/365; 15/256.51; 118/261

[56] References Cited

U.S. PATENT DOCUMENTS 4,398,463 8/1983 Yessler, II ..... 101/169

4,425,848 1/1984 Bell ..... 101/169 X 4,503,770 3/1985 Cox ..... 101/169

FOREIGN PATENT DOCUMENTS 2500764 7/1975 Fed. Rep. of Germany ..... 101/169

825436 12/1959 United Kingdom ..... 101/169

*Primary Examiner*—Edgar S. Burr

*Assistant Examiner*—Moshe I. Cohen

*Attorney, Agent, or Firm*—Hoffmann & Baron

[57] ABSTRACT

The invention relates to the art field of rotary printing machines, and concerns a doctor blade clamp device in the form of a bar with a longitudinal chase that accommodates a pressure plate; the plate is urged against the blade by pressure applied through a reservoir embodied as a hollow flexible sheath, likewise accommodated by the chase, which connects with a supply of pressurized fluid and is made to expand by the operation of a suitable valve.

7 Claims, 1 Drawing Sheet

CLAMP DEVICE FOR THE CYLINDER WIPER BLADE IN A ROTOGRAVURE PRINTING MACHINE

BACKGROUND of the INVENTION

The invention relates to a clamp device for the cylinder wiper blade, or 'doctor', of a rotogravure printing machine.

In rotary machines of the type in question, use is made of engraved cylinders that are inked by methods known to those skilled in the art.

Use is also made of blades, one pressed against each cylinder, for the purpose of wiping and removing surplus ink from non-engraved parts of the surface. The blade is breasted flat against a back-up iron and carried by a bar, to which both are clamped by tightening a set of screws spaced apart at regular intervals along the entire length of the bar.

This system of clamping the bar presents a number of different drawbacks.

A first drawback is attributable to the fact that the clamp screws are tightened by hand; a uniform distribution of clamping pressure cannot therefore be obtained along the length of the blade, and the blade thus undulates, being notably thin and readily deformable.

Undulation of the blade is always encountered with conventional clamping systems, and dictates the need to exert a considerable amount of pressure on the blade in order to ensure a faultless wiping action. This intense mechanical pressure gives rise to early wear on the cylinder, and consequently, to increased running costs.

A further drawback is created by the fact that some considerable time is needed to replace the blade. Yet another drawback stems from the fact that the blade must be sharpened more often, the greater the pressure on the cylinder.

Accordingly, the object of the invention is one of overcoming the drawbacks mentioned above, and more particularly, of reducing the pressure with which the blade is offered to the cylinder.

In order to reduce this pressure, one must solve the problem of how a constant clamping action may be applied to blade and bar along the entire length of the blade, so as to ensure perfect straightness from end to end.

SUMMARY of the INVENTION

Such a problem is solved comprehensively, and the stated object thus achieved, by adoption of a clamp device for the wiper blades of rotogravure printing machinery according to the invention.

The clamp device disclosed comprises a bar affording a longitudinal chase, a pressure plate designed to urge against a back-up iron breasted with the blade, and a reservoir, consisting of a flexible sheath lodged between the pressure plate and one wall of the longitudinal chase, into which pressurized fluid is directed.

BRIEF DESCRIPTION of the DRAWINGS

Two preferred embodiments of the invention will now be described in detail, with the aid of the sheet of drawings attached, in which.

DESCRIPTION of the PREFERRED EMBODIMENTS

Figure 1:
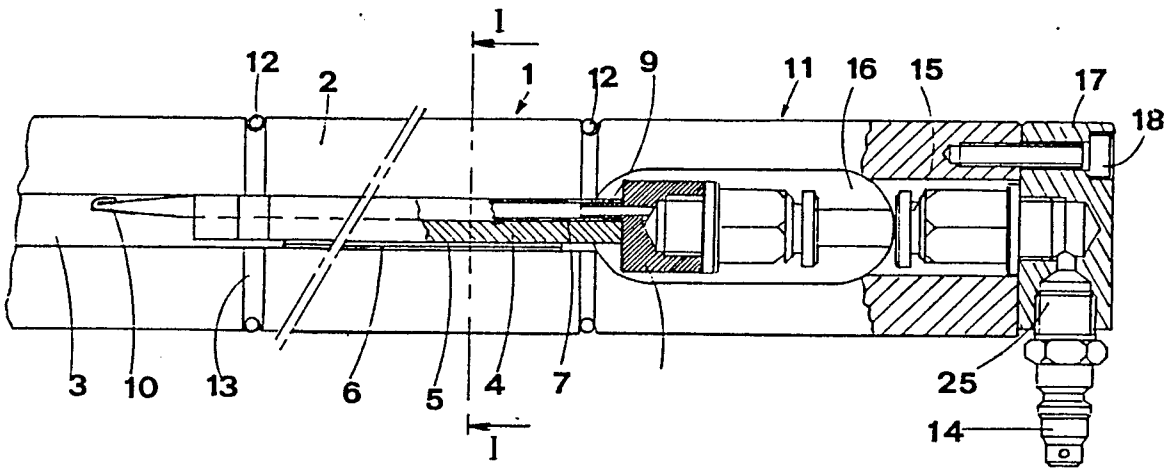
FIG. 1 shows the longitudinal elevation of a first embodiment of the device, viewed partly in section.
Figure 3:
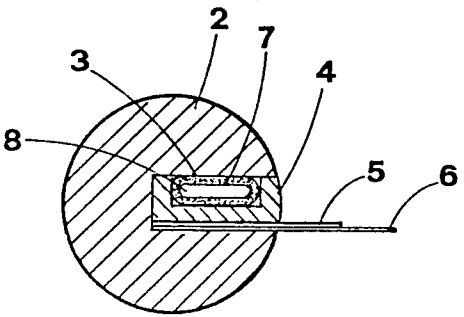
FIG. 3 is the cross section through I—I in FIG. 1.

Referring to FIGS. 1 and 3 of the above drawings, 1 denotes the clamp device in its entirety; such a device comprises a cylindrical bar 2, which exhibits a longitudinal chase 3 of substantially rectangular cross section.

4 denotes a pressure plate of substantially U-shaped section that occupies the longitudinal chase 3 in what is substantially a radial position, its bottom surface breasted with a back-up iron 5; the iron in its turn is breasted with the wiper blade 6.

The 'U' profile of the pressure plate 4 houses a reservoir 7 embodied substantially as a length of flexible sheath encompassing an internal cavity 8. One end of the sheath connects with an inlet duct 9 through which pressurized fluid of whatever nature is directed into the cavity 8; the remaining end is sealed by forming a fold in the flexible material, or effecting a weld, at the point denoted 10. The pressure plate 4 is retained in the longitudinal chase 3 by circlips 12, or other suitable fastening means, seated in corresponding grooves 13 formed in the bar 2.

According to the invention, one end of the bar 2 associates with means, denoted 11 in their entirety, that serve to direct pressurized fluid into the internal cavity 8 of the sheath reservoir 7.

In a first embodiment illustrated in FIG. 1, such means comprise a check valve 25 and quick coupler 14 suitable for compressed air. The valve 25 serves to connect an air supply line (not illustrated) with the inlet duct 9 by way of an assembly of adjustable connections, denoted 15, housed within a recess 16 formed in the cylindrical bar 2; accordingly, the outer butt end of the bar is capped with a cover 17 held in place by screws 18. The check valve 25 will incorporate a spring (not illustrated) which, when compressed, permits exhausting air currently stored in the reservoir to the end of releasing the wiper blade, as will shortly become clear.

Figure 2:
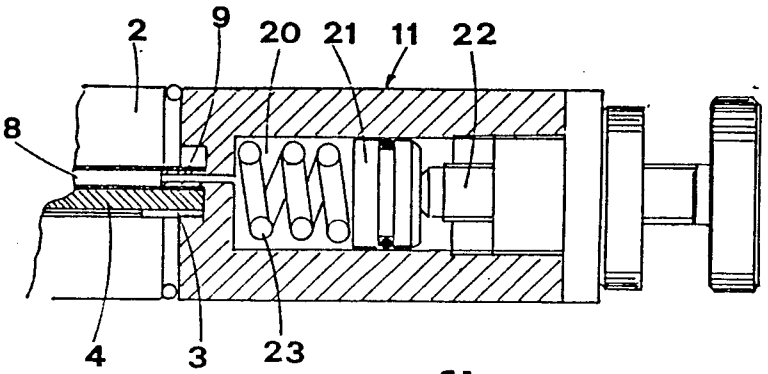
FIG. 2 is the longitudinal section through a second embodiment of the device.

In a second embodiment, illustrated in FIG. 2, means 11 for directing pressurized fluid to the sheath reservoir comprise a chamber 20, formed in the end of the bar, housing a piston 21, and a pressure screw 22 that urges the piston against a spring 23 accommodated by the chamber. The chamber 20 is filled with a fluid such as oil or grease, and connects with the internal cavity 8 of the flexible sheath reservoir 7 by way of the inlet duct 9.

Operation of the device will now be described. With the back-up iron 5 and the blade 6 inserted in the longitudinal chase 3 together with the pressure plate 4, the flexible sheath reservoir 7 is charged with pressurized fluid, which may be compressed air, as in the embodiment of FIG. 1, or oil or grease, as in FIG. 2.

Entry of the pressurized fluid into the internal cavity 8 of the reservoir causes the flexible sheath to expand and urge against the pressure plate 4, which in its turn forces the back-up iron 5 and the blade 6 against the corresponding side wall of the longitudinal chase in the bar.

The sheath reservoir thus ensures that constant and uniformly-distributed pressure is applied along the entire length of the wiper blade.

In embodying the reservoir, the flexible sheath may be fashioned from metal, or in any given plastic material that will remain unaffected by the solvents used in rotogravure printing processes.

What is claimed:

1. A device for clamping the cylinder wiper blade in rotogravure printing machines, comprising:

a bar having a longitudinal chase;

a back-up iron facing said wiper blade;

a pressure plate urging against said back-up iron facing said wiper blade;

a sheath reservoir formed by a flexible sheath lodged between said pressure plate and one wall of said longitudinal chase; and means for selectively directing a pressurized fluid into said sheath reservoir so as to selectively expand said flexible sheath and cause said pressure plate to apply a constant clamping action against said back-up iron along the entire length of said wiper blade, and for selectively exhausting said pressurized fluid out from said sheath reservoir so as to release said wiper blade from said pressure plate and said back-up iron to permit wiper blade disassembly and/or replacement.

2. A device as in claim 1, wherein said bar is cylindrical in shape, and said chase is radially disposed and has a longitudinal extent, extending along the entire length of said bar.

3. A device as in claim 1, wherein said pressure plate exhibits a U-shaped cross section which forms a space for accommodating said sheath reservoir and which has a bottom, said bottom of said U-shaped cross section facing said back-up iron, and said sheath reservoir being accommodated in the space created by the U-shaped section.

4. A device as in claim 1, wherein the flexible sheath reservoir is embodied in any metallic material that will enable the sheath to deform when subjected to internal pressure.

5. A device as in claim 1, wherein the flexible sheath reservoir is embodied in any plastic material that will enable the sheath reservoir to deform when subjected to internal pressure and remain materially unaffected by solvents used in printing inks.

6. A device as in claim 1, wherein said sheath reservoir has an internal cavity and, said means by which said pressurized fluid is selectively directed into the flexible sheath reservoir comprises an inlet duct inserted into said internal cavity of said sheath reservoir, and a chamber connected to said inlet duct and which contains oil or grease pressurized by an externally actuated piston, said chamber accommodating a spring against which said piston is loaded.

7. A device as in claim 1, wherein said means by which said pressurized fluid is selectively directed into the flexible sheath reservoir, comprises an inlet duct to which said pressurized fluid such as compressed air is routed from a main supply line thereof, by way of a check valve.

* * * * *